US008435130B2

(12) United States Patent
Cheresko

(10) Patent No.: US 8,435,130 B2
(45) Date of Patent: May 7, 2013

(54) DIGITAL INERTIALLY RESPONSIVE GOLF CLUB HEAD MOUNTED DEVICE FOR INSTRUCTING CORRECT CLUB FACE DIRECTION AND SWING SPEED

(76) Inventor: Daniel Cheresko, Brighton, MI (US)

( * ) Notice: Subject to any disclaimer, the term of this patent is extended or adjusted under 35 U.S.C. 154(b) by 1106 days.

(21) Appl. No.: 12/395,109

(22) Filed: Feb. 27, 2009

(65) Prior Publication Data

US 2009/0305805 A1 Dec. 10, 2009

Related U.S. Application Data

(63) Continuation-in-part of application No. 11/876,260, filed on Oct. 22, 2007.

(51) Int. Cl.
*A63B 53/06* (2006.01)
*A63B 53/16* (2006.01)

(52) U.S. Cl.
USPC ..... 473/257; 473/258; 473/259; 473/260

(58) Field of Classification Search ..... 473/257–260
See application file for complete search history.

(56) References Cited

U.S. PATENT DOCUMENTS

| | | | | |
|---|---|---|---|---|
| 4,615,526 | A | 10/1986 | Yasuda et al. | |
| 5,161,802 | A | 11/1992 | Daechsel et al. | |
| 5,169,150 | A | 12/1992 | Tindale | |
| 5,230,512 | A | 7/1993 | Tattershall | |
| 5,873,789 | A | 2/1999 | Torriano et al. | |
| 6,139,442 | A | 10/2000 | Wilson et al. | |
| 6,196,932 | B1 * | 3/2001 | Marsh et al. | 473/223 |
| 6,254,493 | B1 | 7/2001 | Wurster | |
| 6,364,785 | B1 | 4/2002 | Chen et al. | |
| 6,375,579 | B1 | 4/2002 | Hart | |
| 6,437,559 | B1 | 8/2002 | Zajac et al. | |
| 6,488,592 | B1 | 12/2002 | Boatner | |
| 6,540,620 | B1 | 4/2003 | Consiglio | |
| 6,887,162 | B2 | 5/2005 | Lindsay et al. | |
| 6,913,542 | B1 | 7/2005 | Hu et al. | |
| 6,935,965 | B1 | 8/2005 | DeVarney | |

(Continued)

FOREIGN PATENT DOCUMENTS

| | | |
|---|---|---|
| JP | 11128430 | 5/1999 |
| JP | 11128431 | 5/1999 |
| WO | WO-95/03098 | 2/1995 |
| WO | WO-97/18015 | 5/1997 |
| WO | WO-98/17354 | 4/1998 |
| WO | WO-2004/028649 | 4/2004 |

OTHER PUBLICATIONS

Edwin Watts Golf-Adams Dixx Putters www.edwinwattsgolf.com/golf-equipment_adams-golf_adams-dixx-putter_.

*Primary Examiner* — Melba Bumgarner
*Assistant Examiner* — Jason Pinheiro
(74) *Attorney, Agent, or Firm* — Gifford, Krass, Sprinkle, Anderson & Citkowski, P.C.; Douglas J. McEvoy

(57) ABSTRACT

A device for establishing a correct speed and angular direction of a striking face associated with a golf club head relative to a golf ball. A body is secured to a surface of the club head and incorporates a powered processor in communication with a separate accelerometer. The body includes a visual output, such as pluralities of LED elements, communicated by the processor and instructing at least one of a desired swing speed and correct direction of the ball striking face relative to the golf ball.

6 Claims, 5 Drawing Sheets

U.S. PATENT DOCUMENTS

| | | | |
|---|---|---|---|
| 7,104,900 | B1 | 9/2006 | Finley |
| 7,112,151 | B2 | 9/2006 | Adams |
| 7,115,044 | B2 | 10/2006 | Faltin |
| 7,131,910 | B2 | 11/2006 | Townsend, II |
| 2002/0173364 | A1 | 11/2002 | Boscha |
| 2003/0032494 | A1 | 2/2003 | McGinty et al. |
| 2003/0203762 | A1 | 10/2003 | Ross |
| 2005/0037862 | A1 | 2/2005 | Hagood et al. |
| 2005/0130755 | A1 | 6/2005 | Lindsay |
| 2005/0202893 | A1 | 9/2005 | Otten et al. |
| 2006/0029916 | A1 * | 2/2006 | Boscha ..... 434/252 |

* cited by examiner

DIGITAL INERTIALLY RESPONSIVE GOLF CLUB HEAD MOUNTED DEVICE FOR INSTRUCTING CORRECT CLUB FACE DIRECTION AND SWING SPEED

CROSS-REFERENCE TO RELATED APPLICATIONS

This Application is a Continuation-in-part of application Ser. No. 11/876,260 filed on Oct. 22, 2007.

FIELD OF THE INVENTION

The present invention relates generally to a golf swing instructional device. More particularly, the present invention teaches a device secured to a conventional club head (including any of a putter, iron or driver) and which incorporates a series of digital input/output components and processor functions which are responsive to inertial input parameters, such as club swing speed and direction, in order to instruct a correct club face orientation relative to a golf ball to be struck.

BACKGROUND OF THE INVENTION

The prior art is well documented with examples of golf club swing training devices. The objective in each instance is to attempt to instruct a golfer in the proper technique associated with a golf swing, and in the hope of assisting a user in more completely connecting with a golf ball and driving the ball straighter and for longer distances.

The Adams Dixx Putter illustrates a computerized training system utilizing a micro inertial navigation system for identifying a correct putter face position in relation to impact with a ball. Relevant data is displayed on an LCD screen with the micro electro-mechanical system monitoring several factors relative to the users swing, including path, impact position, face angle, swing tempo and speed balance. A portable computer terminal is removable and substitutable with a practice weight.

U.S. Pat. No. 6,913,542, issued to Hu et al., discloses a golf club for showing swing condition having a shaft and a connected head with a striking face. Also illustrated is a battery powered and visible illuminant mounted on the head and exposed outside with an upward angle. A centrifugal switch is actuated by applying a centrifugal force and is mounted on the club head opposite the striking face for controlling a circuit between the battery and the illuminant. In this fashion, the illuminant will light upon application of a predetermined strength centrifugal force during swinging of the golf club for investigating the body harmony and strength-exerting condition of a golfer.

Other dynamic and velocity related measuring devices referenced include U.S. Patent Application Publication No. 2002/0173364, to Boscha, incorporating three force sensors built into a club head, a main electronic unit build into a shaft or grip, and a remotely positioned data acquisition, processing and displaying unit connected with the electronic units within the club via IR or RF transmitters. The information collected from the force sensors is employed to construct a dynamic analysis of swings and hits to correlate the results the results with actual movements of the ball, such being presented in display, graphical or digital form.

International Publication No. WO 2004/028649 teaches an apparatus for measuring swing velocity of a golf club head, as well as an advertising apparatus for golf training including the same, and which further employs a pair of magnetic sensors at different head and shaft locations. These interface with a micro controller and display for calculating and outputting either of a swing velocity and/or flying distance of the golf ball.

A further collection of pseudo club shaped golf swing training devices are illustrated in Wurster, U.S. Pat. No. 6,254,493, McGinty, U.S. Publication No. 2003/0032494 and Daechsel, U.S. Pat. No. 5,161,802. McGinty teaches a plurality of optical sensors adjacent a club face for detecting contact between the face and the golf ball, as well as electronics mounted within the head for processing the signals from the sensor for analyzing at least the location of the contact between the face and ball. The electronics further analyze whether the ball is tending to slice or hook by detecting lateral movement of the ball during contact with the club face Wurster and Daechsel both teach golf swing practice devices (non functioning golf clubs) each including a weighted head portion attached to an elongated shaft. In the case of Wurster, a first laser module is mounted in the grip end of the shaft and directs a laser beam upwardly from the grip in coaxial alignment with the central axis of the shaft. A further pair of laser modules are mounted in the head of the training device for directing a pair of spaced parallel laser beams downwardly from the head in diametrically opposed direction from the beam emanating from the grip. The two beams projecting from the head are disposed in a common plane with a downward extension of the central axis of the shaft, such that a line drawn between the points of impact of the beams on the ground visually defines the footprint and thus the angular orientation of an imaginary club face.

Finally, Daechsel teaches another type of golf practice device exhibiting a shortened shaft with unique head weighted to equal the swing of a regular sized club. The head contains a battery for a light, which is centrally mounted with lens and iris to produce a focused, rectangular spot of light, parallel to the shaft center line. A combination level-and-centrifugal switch turns on the light spot when the shaft is level at the start of the down swing, and also as the head travels through the bottom of the swing. The rectangular light beam shows the path of the swing through a target ball, allowing the user to check the accuracy of the swing as well as the squareness of the club head to a target line. The target further comprises a golf ball with electronic receivers on either side in a straight line. The visual light path shows the direction of the swing, and the sound from the electronic receiver indicates to the golfer when a precise swing has been achieved. As repeat accuracy improves with practice, the light beam can be narrowed by adjusting the iris for still greater accuracy.

SUMMARY OF THE INVENTION

The present invention teaches a device for establishing a correct speed and angular direction of a striking face associated with a golf club head relative to a golf ball. A body is secured to a surface of the club head and includes upper and lower assembleable halves, these defining an interior volume for receiving, in sandwiching fashion, a like configured PC board supporting a processor in communication with a separate accelerometer, a control pushbutton switch (accessible through an upper surface of said body and for activating said processor) and individual pluralities of right/left and front/rear extending LED's. A Mosfet P-channel is also supported upon the PC board and is in communication with an input side of the processor.

The body is shaped with a front extending portion and a central interconnecting and rearwardly extending portion, the first and second individual sub-pluralities of left and right front extending and directional indicating LED's provided along the front extending portion, with a third sub-plurality of rearwardly extending tempo indicating LED's provided along the rearwardly extending portion. The LED's are communicated by the processor for instructing at least one of a desired swing speed and correct direction of the ball striking face relative to the golf ball.

Additional features include a battery (such as rounded Lithium Ion type) secured within a lower half (or base) housing and in parallel communication with the processor and visual output LED's. A battery access door is defined upon a forward accessible underside of the lower half and in order to allow for replacement of the battery.

First and second club head engaging and adjustable foot supports extend from the lower half along the front extending portion. The body, such as the lower half can be constructed of a magnetized material in order to facilitate engaging to the top supporting surface of a metallic club head. In such instance, the foot supports operate primarily to locate the position of the device relative to the club face. The foot supports include ratcheting step portions seating within at least one lengthwise extending track or pocket defined along the front portion, these permitting the foot supports to be repositioned both laterally and inwardly/outwardly relative to the body.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
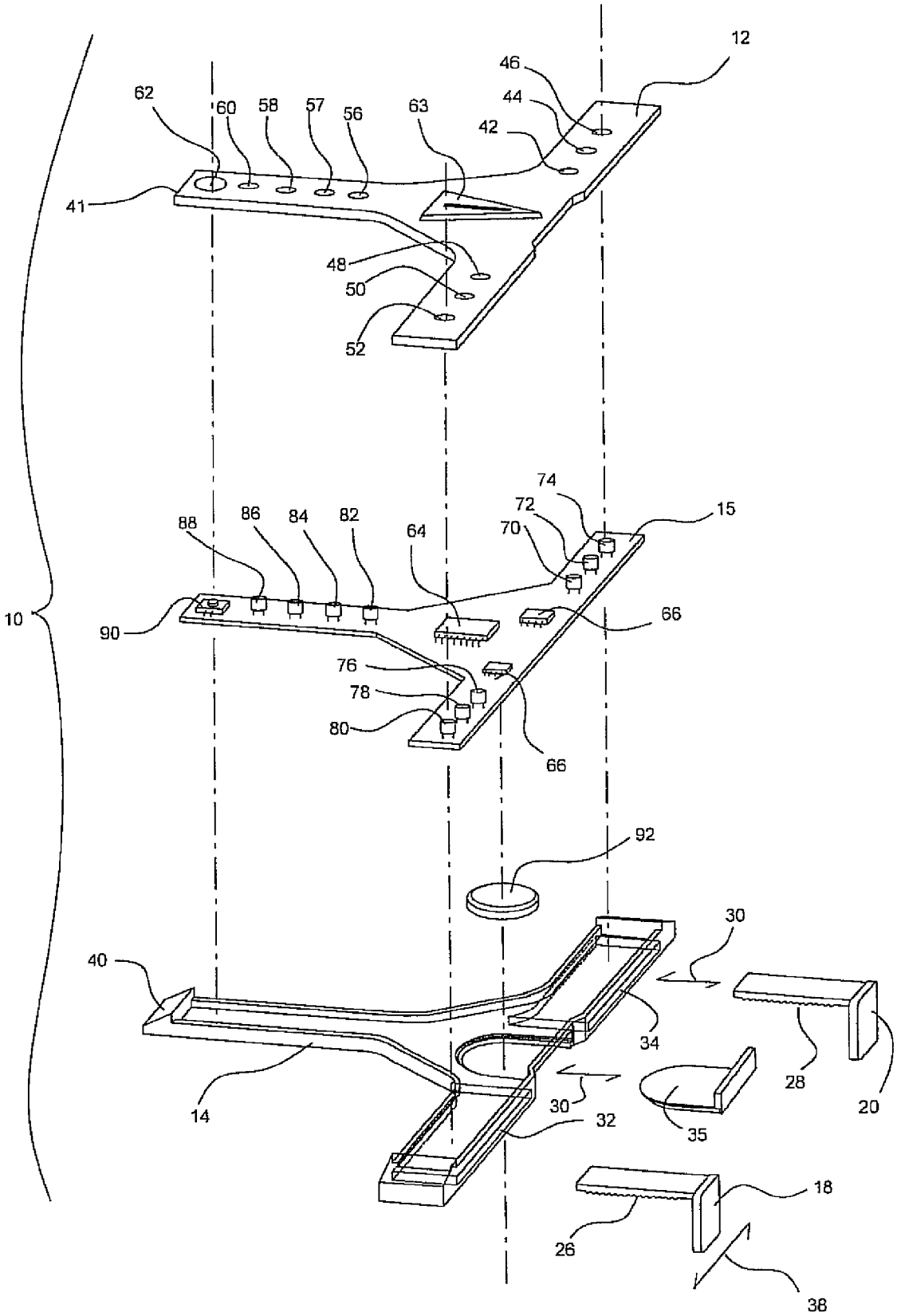
FIG. 1 is an exploded view of the digital inertially responsive club head mounted device, including upper and assembleable housing with intermediately positioned PC board supporting thereupon a processor and related components including output LED's, for instructing both swing speed (tempo) and direction (targeting) according to the present invention.

Referring to FIG. 1, an exploded view is shown at 10 of a digital inertially responsive club head mounted device, including housing and components, for instructing both swing speed (tempo) and direction (targeting) according to the present invention. The present invention discloses a device secured to an existing club head and which utilizes a processor and digital output circuitry for instructing a user as to correct planar orientation of a contacting face of a golf club relative to a golf ball, such as for a selected swing speed (tempo). As will also be described, the club device optionally includes a directional readout component for assisting in correcting a left/right offset of the club face when striking a ball.

In combination with the various illustrations shown in FIGS. 2-10, the device exhibits a three dimensional housing collectively defined by an upper half 12 and a lower assembleable half 14, the upper and lower halves being snap fit together, sonically welded or assembled in some other fashion to define a component supporting interior. The housing can be constructed of a durable plastic or other material construction and which further establishes an open interior into which is inserted a like configured PC board 15 upon which are secured a plurality of components associated with the device and which will be described in additional detail.

Figure 2:
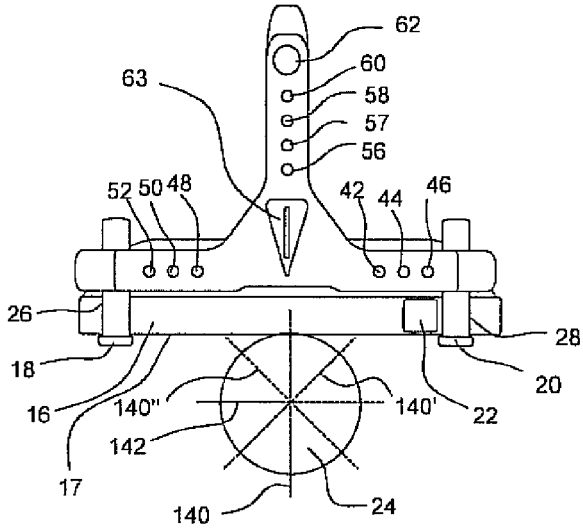
FIG. 2 is a top environmental view of the digital device secured to a club head and in relation to a golf ball.
Figure 3:
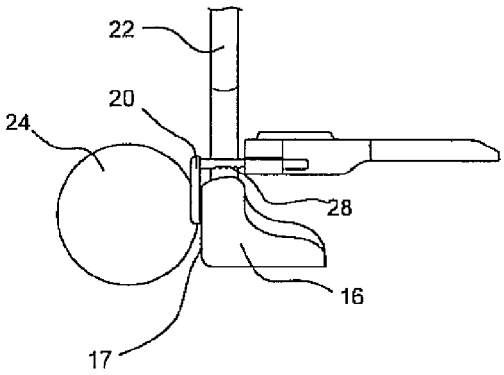
FIG. 3 is a side view of the device shown in FIG. 2.
Figure 4:
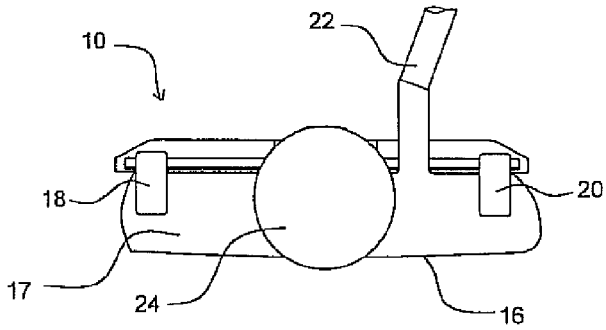
FIG. 4 is a front view of the device shown in FIG. 2.
Figure 5A:
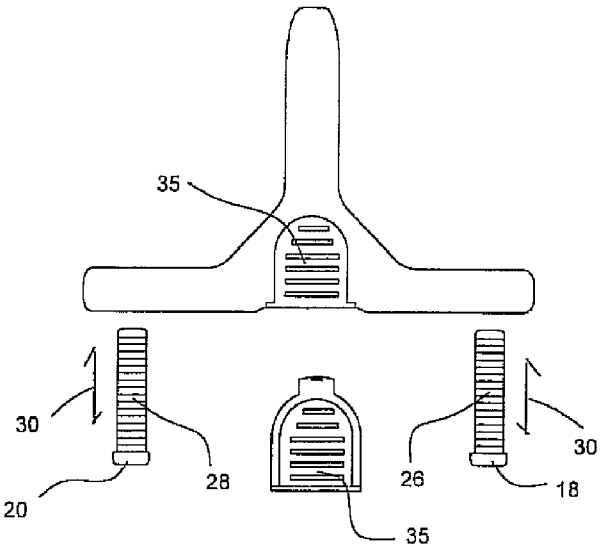
FIG. 5A is a corresponding plan view of the bottom surface of the device and again illustrating in exploded fashion the fastening legs with support feet in combination with the battery access door.
Figure 5:
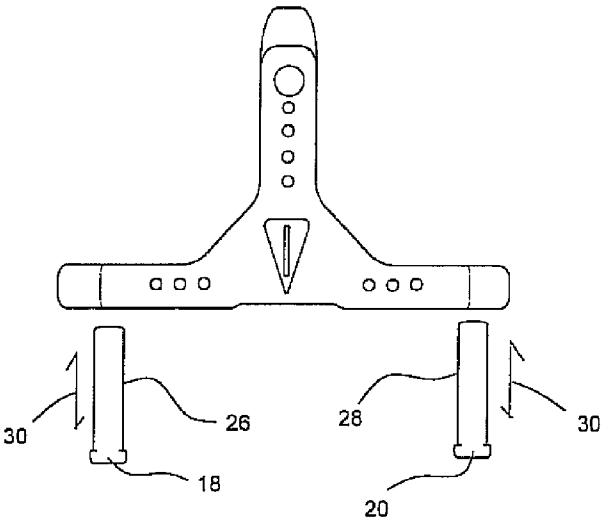
FIG. 5 is a plan view of the top surface of the device and further showing the features of the fastening legs with support feet in partially exploded fashion and extending from the front face of the housing.

The assembled device is secured to a club head, such as shown at 16 in each of FIGS. 2-4, through the use of a pair of ratchet adjustable front legs with feet 18 and 20 engageable with a front face 17 of the golf club head 16, the golf club further including a shaft 22 connecting to a top edge location of the club head 16 and extending upwardly therefrom. As shown, the support feet 18 and 20 assist in locating the device 10 upon a top surface of the club head 16, and without interfering with a front ball striking face (see as further shown in FIGS. 2-4) arrayed relative to a golf ball 24.

As shown, the device 10 presents a generally "T" shape in configuration with an elongated front portion extending parallel with the club striking face (again FIGS. 2-4) and an intermediately positioned and rearwardly extending central body portion, this incorporating many of the electronic components associated with the device and which are illustrated mounted upon the PC board in the exploded view of FIG. 1. In any of a number of non-limiting embodiments, the housing can exhibit varying sizes and patterns, such as including front and rear extending dimensions in the 2-5" range and in order to be feasibly mounted to a dimensioned upper surface of a golf club putter, driver or fairway iron.

As further again shown, the front adjustable feet 18 and 20 include ratcheting stem portions, see at 26 and 28. The ratchet portions 26 and 28, as best shown in FIG. 1, exhibit serrated undersides, these allowing repositioning in forward/rearward directions (see arrows 30), relative to ratchet adjustable receiving tracks (see further at 32 and 34), thereby permitting the front feet to readjust to varying inner/outer positions for securing to the front face 17 of the golf club (again FIGS. 2-4).

Figure 7:
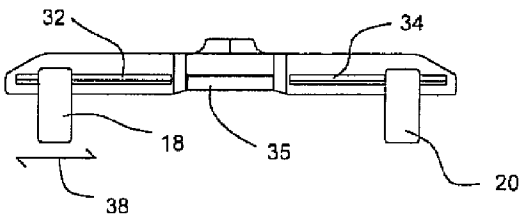
FIG. 7 is a front view of the housing shown in FIG. 5 and further showing the lateral adjustability of the foot supports provided by the fastening legs secured within the widthwise extending tracks.
Figure 6:
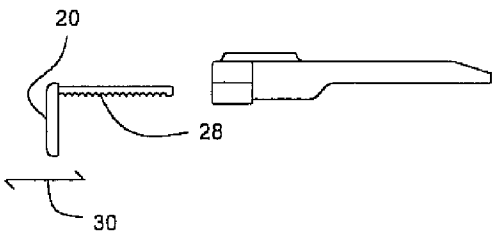
FIG. 6 is a side view of the housing shown in FIG. 5 and further illustrating the ratcheting aspect of the fastening legs shown in partially exploded fashion.

As further shown in the frontal view of FIG. 7, the recess adjustable tracks 32 and 34 further exhibit an open front profile defined by both a widthwise and depthwise extending profile, this permitting the ratcheting stem portions 26 and 28 and associated front support feet 18 and 20 to be laterally repositioned, see bidirectional arrow 38 in FIG. 1, to facilitate correct location of the device 10 relative to any of a number of golf club striking faces (again at 17) of varying dimensions. The configuration of the crosswise extending tracks 32 and 34 is further such that they can interface with a ratcheting stem portion profiled or configured to allow the front feet 18 and 20 to be depth-wise readjusted (e.g. movable in directions towards and away from the lower assembleable body half 14, and while at the same time permitting the front legs to be slidably repositioned in the manner shown in FIG. 7.

As firer shown in FIG. 1, a rear configured abutment ledge 40 associated with the assembleable lower half 14 provides an end-stop location against which a corresponding rear edge (see at 41) of the top assembleable half 12 locates during assembly, the like configured PC board 15 seating in recessed fashion between the upper half 12 and lower recess defining half 14. A battery door 35 is also shown and illustrates a generally arcuate and planar shaped component, exhibiting a forward angled edge, and which secures to a forward underside edge location of the lower half 14, in order to reveal and permit replacement of a battery (see as subsequently described at 92).

It is also envisioned that the device 10, or at least the base securing halt 14, can be constructed of a magnetized material and which attracts to a suitably configured top metallic surface of a putter, iron or (in limited applications) a driver, such that a suitable adhering attracting force is created to prevent accidental disengagement of the device 10 from the club head 16 resulting from the inertial forces of swinging or pendulum rotating the club. In such an application, the ratchet adjusted feet 18 and 20 operate primarily to locate the device upon the top surface of the club head, as opposed to establishing an outright gripping or securing function. That said, it is also envisioned to utilize adhesives and other mechanical/chemical fasteners for securing the device 10 to a suitably configured golf club head.

Figure 10:
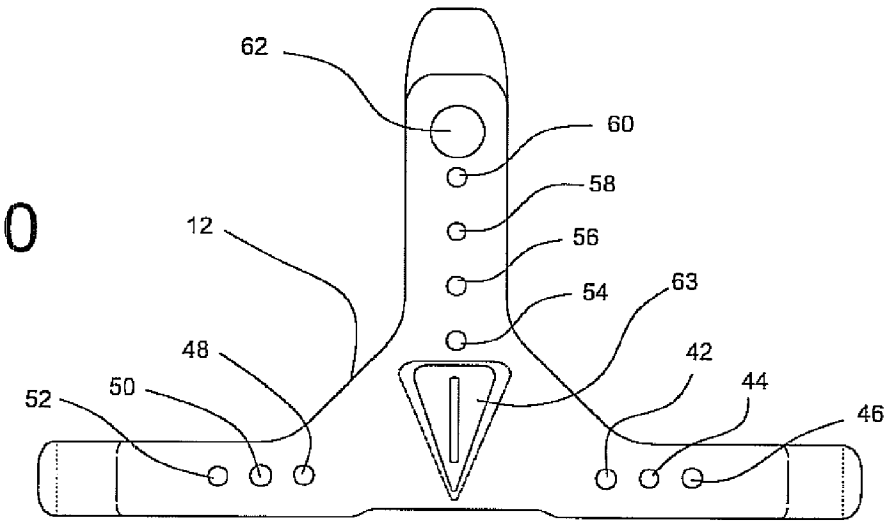
FIG. 10 is a plan view illustration of the upper assembleable housing shown in FIG. 1 and further illustrating the various access windows.

As best illustrated in FIGS. 1 and 10, the upper exposed face of the upper half 12 exhibits individual pluralities of indicator windows, these established by such as transparent portions defined in the upper housing 14 and extending in spaced fashion along both the left and right front extending wings, as well as rearwardly along the central interconnecting portion of the upper half 12. These namely include left front windows 42, 44 and 46, right front windows 48, 50, and 52, and central and rear extending windows 54, 56, 58 and 60. Also illustrated is an access location 62 for a control pushbutton switch (as subsequently shown at 90), this established at a generally rearward most location of the upper half central body portion, the function for which will be subsequently described. Also illustrated at 63 is a generally shaped arrow portion associated with the upper half 12, this centrally aligning with a central location of the club face 17 relative to the location of the ball 24 (see FIG. 2) and in order to ensure that the ball is evenly and centrally struck relative to the position of the device 12.

Figure 9:
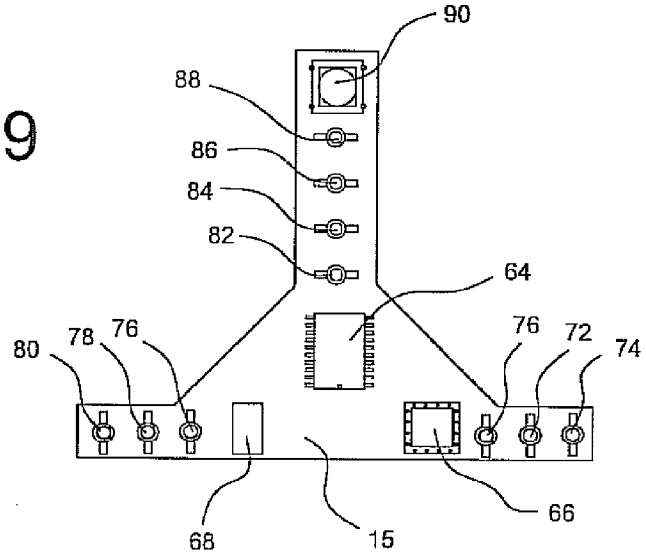
FIG. 9 is a plan view illustration of the PC board shown in FIG. 1, and upon which is mounted the various LED, switch, and processor components associated with the present design.
Figure 8:
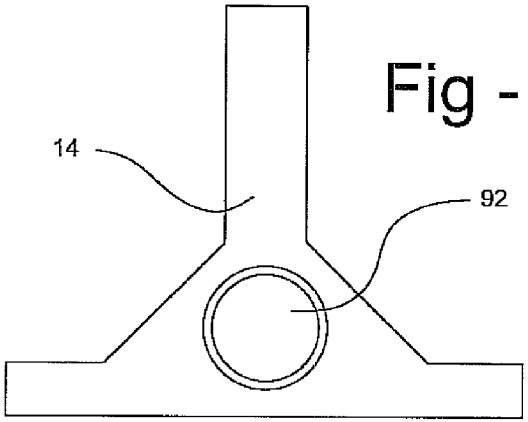
FIG. 8 is a plan view illustration of the bottom half of the device housing also shown in FIG. 1.

As further shown in the exploded view of FIG. 1 as well as the plan view of FIG. 9, the components mounted to the configured PC board 17 (this again mating with the internal perimeter created by the assembleable upper half 12 and lower recess defining half 14), and for providing the digital input/output functions associated with the inertial (tempo) and directional (targeting) aspects include a central microprocessor 64, an accelerometer 66, and a Moffset P-channel 68. Illuminating components, such as pluralities of highly luminescent and durable light emitting diodes (or LED's) are provided, these communicating with an output side of the microprocessor and include left front LED's 70, 72 and 74, right front LED's 76, 78 and 80, and central extending LED's 82, 84, 86 and 88. Also shown at 90 is the control pushbutton switch which seats at the generally rear extending end of the central portion of the upper half 12 and so that the pushbutton seats through location 62. Further shown at 92 is the battery, such as a Lithium ion type watch battery, and which can be supported upon the lower assembleable body half 14 in the manner previously described and through application of the battery access door 35.

Figure 11:
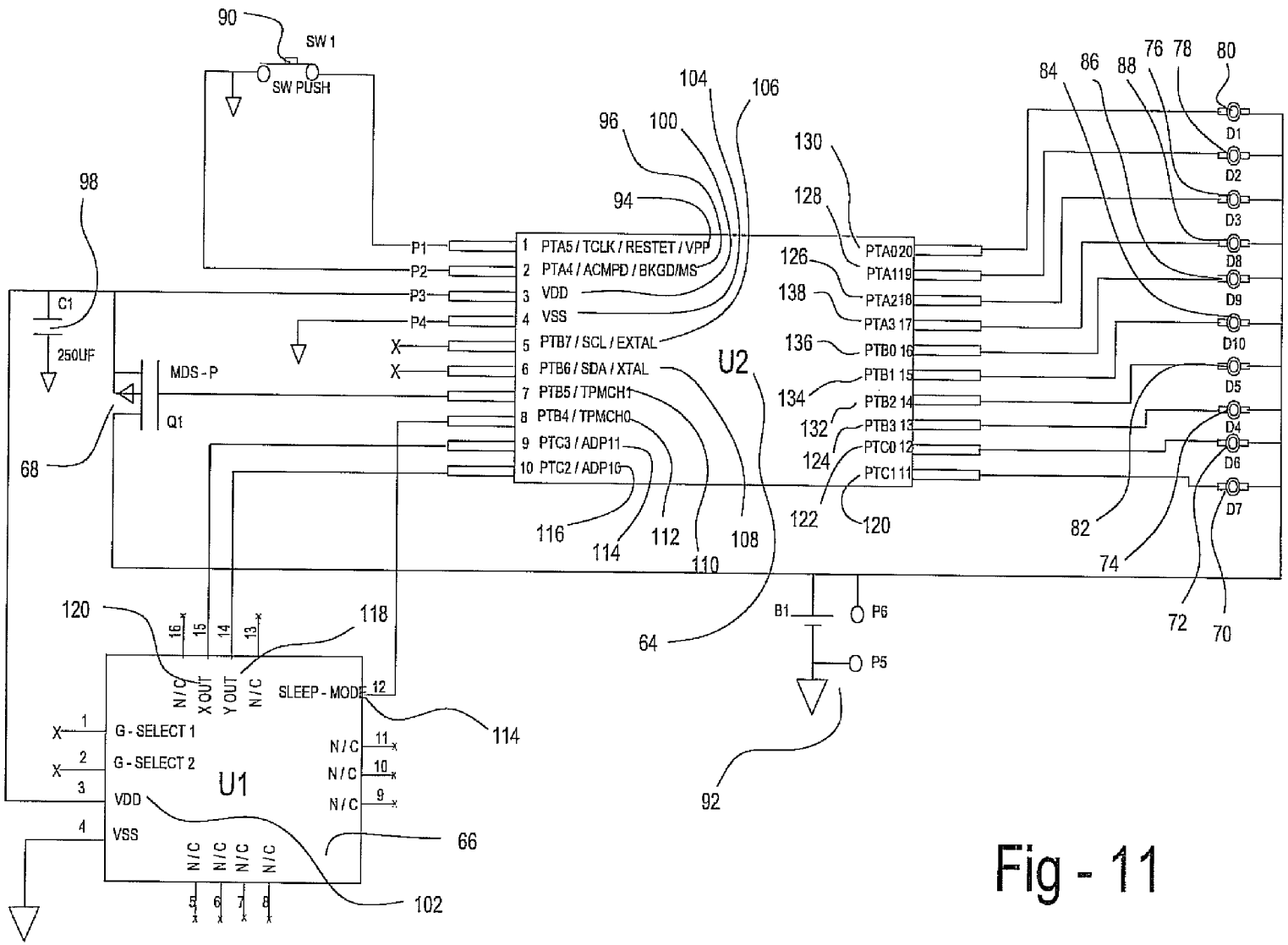
FIG. 11 is a schematic illustration featuring the central processor in relation to the accelerometer and associated circuit components on the input side, as well to the various speed and directional LED outputs on the output side.

With reference to FIG. 11, a schematic illustration features the central processor 64 in relation to the accelerometer 66 and associated circuit components on the input side, as well to the various speed/tempo LED's 70-74 and 76-80 and directional LED's 82-88 located on an output side. The processor 64 includes such as eight bit and twenty pin capacity, with low operating power requirements. In one non-limiting application, processor run-time, including LED current draw, can approximate in a range of 200 mA per hour. In operation, the CPU 64 operates to activate, such as in successive fashion, one or more of the individual sub-pluralities of the LED's, as well as to control the activation time and directional (xy XL axes) orientation of the device.

Referring again to FIG. 11, control pushbutton switch 90 is represented on input side of the processor 64 and in communication with input pins 94 and 96. According to one operational variant, the pushbutton 92 is initially triggered to activate the device, with subsequent depressing of the button causing a rest function to engage. The device may further be configured to automatically shut off in the event that no input change (e.g. reset), such occurring after 1 minute, with the processor 64 further being programmed to cut of illumination of the LED's located on the output side, such as after fifteen seconds (again in the absence of the pushbutton 90 being engaged in a reset function).

A capacitor 98 is shown (again FIG. 11) and is communicated on an input side by input pin 100 of the processor 64, with an output line associated with the capacitor 98 extending to an input location 102 of the accelerometer 66. Additional processor input pin 104 extends to ground with succeeding input side pins 106 and 108 not active in the illustrated embodiment.

Additional processor input pin 110 extends to an input side of Moffset P-channel 68, a corresponding output side being communicated in parallel to an input of capacitor 98 and a common output side of all ten LED's 70-88 in combination with the power supply 92 (the power supply thereby operating in parallel the processor 64 and the illumination of any plurality of LED elements). Further input side pin 112 extends to a sleep mode input 114 associated with the accelerometer 66, with additional input pins 116 and 118 extending to X and Y coordinate inputs also associated with the accelerometer.

On the output side, pins 120, 122, and 124 correspond to left side LED's 70, 72 and 74, with pins 126, 128 and 130 corresponding to right side LED's 76, 78 and 80. Finally, output pins 132, 134, 136 and 138 correspond to tempo indicating LED's 82, 84, 86 and 88. Additionally, and although not separately enumerated, it is also understood that communication lines as shown in the schematic of FIG. 11 extend between the input and output pin connections of the CPU 64 to the various other components and LED's consistent with the description provided above.

In operation, the CPU 64 (once initially activated or reset by the pushbutton switch 90) operates on the input side to analyze both swing speed (tempo) and directional (targeting/directional) parameters associated with device 10 mounted atop the golf club head. Depending upon the output of the accelerometer 66, the CPU 64 illuminates (again typically in successive fashion) one or more of the left 70-74 or right 76-80 sub-pluralities of LED's and which is indicative of the ball striking face of the club head being arrayed at an (undesirable) angle relative to the ball 24, this further corresponding to an open or closed face condition between the club face and ball.

It is further envisioned that a swing stroke corresponding to none of the left or right side LED elements being illuminated can be representative of a desired (exemplary) stroke, such as further represented in FIG. 2 by perpendicular directional line 140 extending from the golf club striking face 16 intersecting a midpoint defining line 142 of the golf ball 24, the achievement of which is desired. For illustrative purposes, offset defining lines 142' and 142" further represent such as (exaggerated) open and closed face conditions and which can result from the golf club striking face not being aligned in proper perpendicular fashion relative to the midpoint extending center line 142.

Concurrently, the accelerometer determines if the swing speed (tempo) of the device 10 is such that it exceeds (or even falls below) a desired target speed associated with a determined swing cycle (including fairway or iron swings as well as putting strokes) and, in response to such tempo output, instructs the CPU 64 to successively illuminate one or more of the central body portion mounted LED's 82-88. In one corresponding operating protocol, the reverse stroke of the club results in none of the LED's being illuminated, however a given (subset) plurality of LED's associated with the central portion illuminate as being representative of a corresponding swing tempo It is also envisioned that the progressively illuminated LED's (both direction and tempo) are successively greater in their intensity (resulting from correspondingly greater input wattages) and to better evidence the incremental nature of any club face misalignment and/or swing tempo.

Having described my invention, other and additional preferred embodiments will become apparent to those skilled in the art to which it pertains and without deviating from the scope of the appended claims.

By example, each of the previously identified sub-pluralities of LED's can exhibit different color schemes to assist in ready recognition and in addition to providing varying levels of intensity to signify a given sub-plurality of LED's being illuminated and representing a degree of directional misalignment of the club face and/or a swing speed/tempo error. Additional variants also contemplate the components supported upon the PC board being directly incorporated in some other fashion within the interior defined between the upper and lower body halves or, in further contemplated variants, being directly secured to inside facing surfaces of the upper and lower halves.

I claim:

1. A device for establishing a correct speed and angular direction of a striking face associated with a golf club head relative to a golf ball, comprising:

a body secured to a surface of the club head and incorporating a powered processor in communication with a separate accelerometer;

said body further comprising a lower half and an assembleable upper half defining an interior within which is supported a PC board containing said processor and accelerometer;

said visual output further comprising at least one plurality of LED elements located upon said PC board and visible from said body;

said body further comprising a substantially T shape with a front extending portion and a central interconnecting and rearwardly extending portion, said plurality of LED elements further comprising first and second individual sub-pluralities of left and right front extending and directional indicating LED's, and a third sub-plurality of rearwardly extending tempo indicating LED's;

first and second club head engaging foot supports extending from said front extending portion;

each of said first and second foot supports including ratcheting step portions seating within at least one lengthwise extending track defined along said front portion and to permit said foot supports to be adjusted both laterally and inwardly or outwardly relative to said body; and said body further including a visual output communicated by said processor and instructing at least one of a desired swing speed and correct direction of the striking face relative to the golf ball.

2. The device as described in claim 1, further comprising a control pushbutton switch supported upon said PC board and accessible through an upper surface of said body and for activating said processor.

3. The device as described in claim 1, further comprising a battery secured within said housing which is revealed by an access door associated with a front edge of said lower half.

4. The device as described in claim 1, further comprising a Mosfet P-channel secured to a further location of said PC board in communication with an input side of said processor.

5. A device for establishing a correct speed and angular direction of a striking face associated with a golf club head relative to a golf ball, comprising:

a body secured to a surface of the club head and including a lower half and an assembleable upper half defining an interior volume containing a powered processor in communication with a separate accelerometer, a control pushbutton switch accessible through an upper surface of said body and for activating said processor;

said body further comprising a front extending portion and a central interconnecting and rearwardly extending portion, first and second individual sub-pluralities of left and right front extending and directional indicating LED's provided along said front extending portion, a third sub-plurality of rearwardly extending tempo indicating LED's provided along said rearwardly extending portion, said LED's communicated by said processor for instructing at least one of a desired swing speed and correct direction of the striking face relative to the golf ball;

a battery secured within said housing and in parallel communication with said processor and a visual output;

first and second club head engaging foot supports extending from said front extending portion;

each of said first and second foot supports including ratcheting step portions seating within at least one lengthwise extending track defined along said front portion and to permit said foot supports to be adjusted both laterally and inwardly or outwardly relative to said body.

6. The device as described in claim 5, further comprising a Mosfet P-channel in communication with an input side of said processor.

* * * * *